US007806640B2

(12) United States Patent
Hattori et al.

(10) Patent No.: US 7,806,640 B2
(45) **Date of Patent: *Oct. 5, 2010**

(54) BOOKBINDING APPARATUS, BOOKBINDING SYSTEM, AND ADHESIVE COATING METHOD

(75) Inventors: Masato Hattori, Hino (JP); Masaki Matsui, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 683 days.

This patent is subject to a terminal disclaimer.

(21) Appl. No.: 11/714,232

(22) Filed: Mar. 6, 2007

(65) Prior Publication Data

US 2008/0056847 A1 Mar. 6, 2008

(30) Foreign Application Priority Data

Aug. 30, 2006 (JP) ..... 2006-233321

(51) Int. Cl.
*B42C 9/00* (2006.01)

(52) U.S. Cl. ..... 412/14; 412/37; 412/33; 156/359; 118/693; 270/58.09

(58) Field of Classification Search ..... 118/666, 118/667, 693; 156/351, 359, 578, 908; 270/58.04, 270/58.09; 412/1, 2, 4, 6, 8, 11, 12, 14, 19, 412/33, 37, 41, 902, 908; 700/299
See application file for complete search history.

(56) References Cited

U.S. PATENT DOCUMENTS 6,093,279 A * 7/2000 Detterman et al. ..... 156/295
6,685,416 B2 * 2/2004 Itoh et al. ..... 412/37
7,527,465 B2 * 5/2009 Toyoizumi et al. ..... 412/37
2005/0238462 A1 * 10/2005 Oota ..... 412/9
2006/0115646 A1 * 6/2006 Fujiwara et al. ..... 428/343

FOREIGN PATENT DOCUMENTS

JP 2004-209746 7/2004
JP 2004-276457 10/2004
JP 2004-305881 11/2004

OTHER PUBLICATIONS

Office Action from Japanese Patent Application No. 2006-233321 dated Sep. 16, 2008.

* cited by examiner

*Primary Examiner*—Dana Ross
*Assistant Examiner*—Pradeep C Battula
(74) *Attorney, Agent, or Firm*—Finnegan, Henderson, Farabow, Garrett & Dunner, L.L.P.

(57) ABSTRACT

A bookbinding apparatus for forming a booklet by coating an adhesive on a spine of a stack of sheets, including: a coating apparatus, which has an adhesive reservoir to store a liquid of the adhesive, and a coating roller to coat on the spine the adhesive scooped up from the adhesive reservoir; a pellet storage section to store pellets of the adhesive; a replenishing section to replenish the pellets of the adhesive into the adhesive reservoir; an adhesive quantity sensor to detect a liquid level in the adhesive reservoir; and a controller to control the replenishing section based on a detection signal of the adhesive quantity sensor, wherein the controller controls a rate of replenishing amount of the pellets by controlling the replenishing section based on information of the stack of sheets.

8 Claims, 8 Drawing Sheets

FIG. 8 ( a )
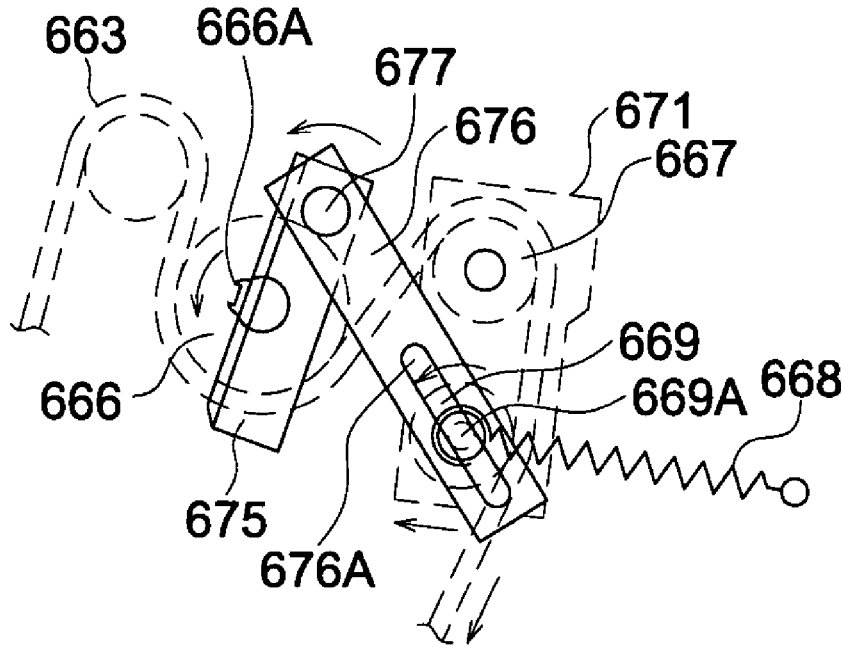
FIG. 8 ( b )
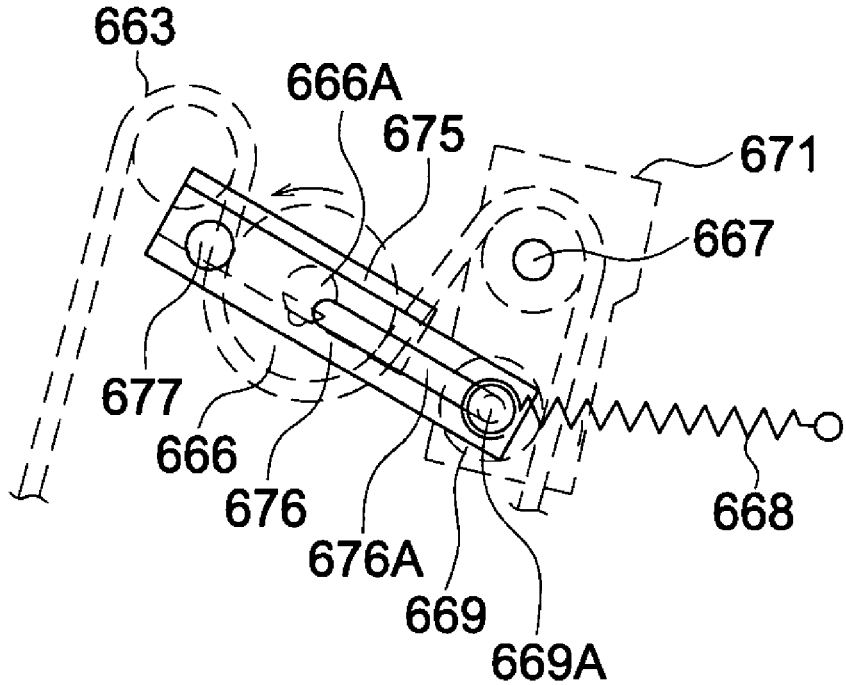

BOOKBINDING APPARATUS, BOOKBINDING SYSTEM, AND ADHESIVE COATING METHOD

CROSS REFERENCE TO RELATED APPLICATION

The present application is based on Japanese Patent Application No. 2006-233321 filed with Japan Patent Office on Aug. 30, 2006, the entire content of which is hereby incorporated by reference.

BACKGROUND OF THE INVENTION

1. Technical Field of the Invention

The present invention relates to bookbinding apparatuses, bookbinding systems, and adhesive coating methods that form booklets by coating an adhesive on the edge (spine) of a plurality of sheets that have been stacked, and, in particular, to bookbinding apparatuses, bookbinding systems, and adhesive coating methods that carry out adhesive coating operation for each individual booklet.

2. Description of Related Art

Bookbinding apparatuses that coat the adhesive for each booklet and bind the sheets are used frequently in bookbinding systems that carry out in one sequence the operations from image formation up to bookbinding. In such bookbinding apparatuses, hot melt type adhesives are used, and the binding operation is carried out continuously by replenishing small quantities of the pellets of the adhesive according to the consumption due to coating. In Patent Documents 1 and Patent Document 2, a replenishing apparatus has been disclosed in which the adhesive is coated on the stack of sheets by moving the coating roller along the spine of the stack of sheets, and pellets of adhesive are replenished at a constant rate in units of a few pellets to the molten adhesive reservoir in which the coating roller is dipped.

Patent Document 1: Unexamined Japanese Patent Application Publication No. 2004-209746.

Patent Document 2: Unexamined Japanese Patent Application Publication No. 2004-276457.

In a coating apparatus that coats the adhesive by moving the coating apparatus constituted to have a coating roller and an adhesive reservoir along the spine of the stack of sheets, since there is a restriction on the volume of the coating apparatus, even the volume of the adhesive reservoir will be restricted.

Because of this, the extent of lowering of the liquid level in the adhesive reservoir becomes large due to the reduction in the quantity of liquid that is consumed by coating, and in order to make the coating uniform, a means is required to suppress the up and down displacement of the liquid level.

In Patent Document 1 and Patent Document 2, a constant quantity of pellets is being supplied when the quantity of adhesive in the adhesive reservoir becomes small, and because of this, the adhesive liquid level is maintained constant. However, according to the adhesive replenishment method of Patent Document 1 and Patent Document 2, there will be up and down displacement of the adhesive liquid level, and it is difficult to carry out uniform coating. This is because of the following reasons.

This is explained below using FIGS. 1(*a*) to 1(*c*).

The liquid level LS of the molten adhesive is detected using an adhesive quantity sensor TS that detects the temperature, and, as is shown in FIG. 1(*a*) to FIG. 1(*b*) or FIG. 1(*c*), when the adhesive quantity sensor TS gets separated from the liquid level LS due to lowering of the liquid level LS, the temperature detected by the adhesive quantity sensor TS falls, and hence a lowering of the liquid level LS is detected.

When the volume of the adhesive reservoir BT is small, since the ratio of the quantity of adhesive scooped up by the coating roller RL to the quantity of adhesive in the adhesive reservoir is high, the fluctuations in the position of the liquid level is large, and when the thicknesses of the stack of sheets to be coated are different, there will be cases in which the state changes from that of FIG. 1(*a*) to FIG. 1(*b*) and from that of FIG. 1(*a*) to FIG. 1(*c*) due to one coating process.

Further, as is shown in the FIG., when the coating roller rotates as shown by the arrow mark, although the liquid level LS of the adhesive becomes high on the downstream side of the direction of rotation of the coating roller RL due to the viscosity of the liquid, the level of the liquid level LS on the downstream side is rather stable, and by detecting on the downstream side, it is possible to detect he quantity of adhesive in the adhesive reservoir accurately.

The adhesive quantity sensor TS cannot distinguish between the conditions of FIG. 1(*b*) and FIG. 1(*c*) by merely detecting that the state has changed from FIG. 1(*a*) to FIG. 1(*b*) and from FIG. 1(*a*) to FIG. 1(*c*). In other words, the adhesive quantity sensor TS carries out only ON/OFF detection, and cannot detect the amount of reduction in the level of the liquid level.

Therefore, when replenishment of adhesive is carried out using the detection signal from an adhesive quantity sensor such as in FIG. 1(*a*) to FIG. 1(*c*), due to the difference in the rate of consumption of the adhesive, the liquid level of the adhesive moves up and down, and it becomes difficult to carry out uniform coating.

If a plurality of adhesive quantity sensors is used, although it is possible to detect multiple levels of the liquid level, there are problems in terms of cost and the space for installing the adhesive quantity sensors, and the problem becomes more pronounced when increasing the accuracy of detection.

The present invention is intended to solve this kind of problems in replenishing adhesive to the coating apparatus, and the purpose of the present invention is to provide a bookbinding apparatus that makes it possible to coat uniformly using a coating apparatus that has been made small in size.

SUMMARY OF THE INVENTION

A configuration reflecting one aspect of the present invention is a bookbinding apparatus for forming a booklet by coating an adhesive on a spine of a stack of sheets, the bookbinding apparatus comprising: a coating apparatus, which includes, an adhesive reservoir to store a liquid of the adhesive, and a coating roller to coat on the spine of the stack of sheets the adhesive scooped up from the adhesive reservoir; a pellet storage section to store pellets of the adhesive; a replenishing section to replenish the pellets of the adhesive from the pellet storage section into the adhesive reservoir; an adhesive quantity sensor to detect a liquid level in the adhesive reservoir; and a controller to control the replenishing section based on a detection signal of the adhesive quantity sensor, wherein the controller controls a rate of replenishing amount of the pellets by controlling the replenishing section based on information of the stack of sheets.

A system reflecting another aspect of the present invention is a bookbinding system comprising: an image forming apparatus for forming images on sheets; and the bookbinding apparatus described above, wherein the bookbinding apparatus receives the sheet from the image forming apparatus and forms the booklet.

A method reflecting another aspect of the present invention is an adhesive coating method for coating an adhesive on a spine of a stack of sheets by moving relatively a coating apparatus and the stack of sheets along the spine of the stack of sheets, the coating apparatus having an adhesive reservoir to store a liquid of the adhesive and a coating roller to coat the adhesive scooped up from an adhesive reservoir, the adhesive coating method comprising the steps of: detecting a liquid level of the adhesive in the adhesive reservoir by an adhesive quantity sensor; activating a replenishing section to replenish pellets of the adhesive from a pellet storage section into the adhesive reservoir, when lowering of the liquid level is detected by the adhesive quantity sensor, wherein a rate of replenishing amount of the pellets is made changeable.

BRIEF DESCRIPTION OF THE DRAWINGS

These and other objects, advantages and features of the invention will become apparent from the following description thereof taken in conjunction with the accompanying drawings in which:

FIGS. 8(*a*) and 8(*b*) are diagrams showing the drive system in the replenishing device 61;

DETAILED DESCRIPTION OF THE PREFERRED EMBODIMENT

Although the present invention is described here using a preferred embodiment shown in the figures, the present invention shall not be limited to the preferred embodiment.

Figure 1:
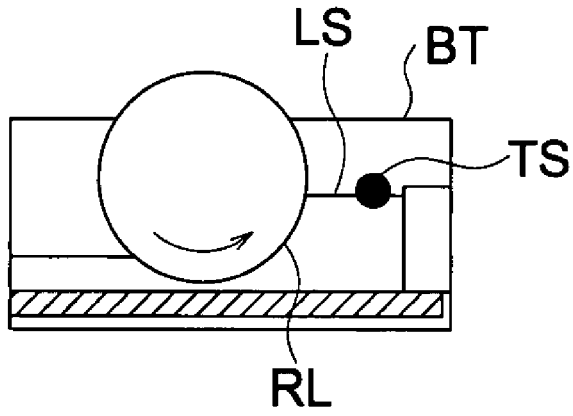
FIGS. 1(*a*) to 1(*c*) are diagrams showing the detection of the adhesive quantity by the liquid level fall sensor.
Figure 1:
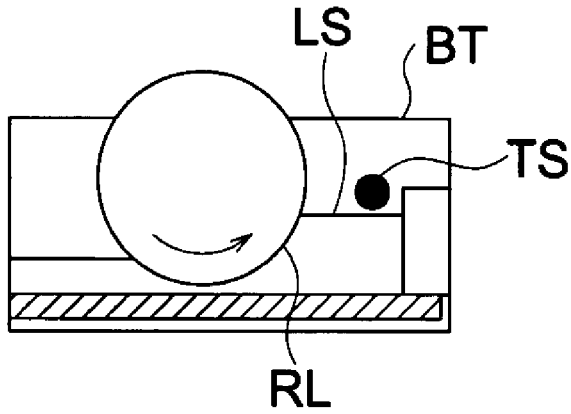
Figure 1:
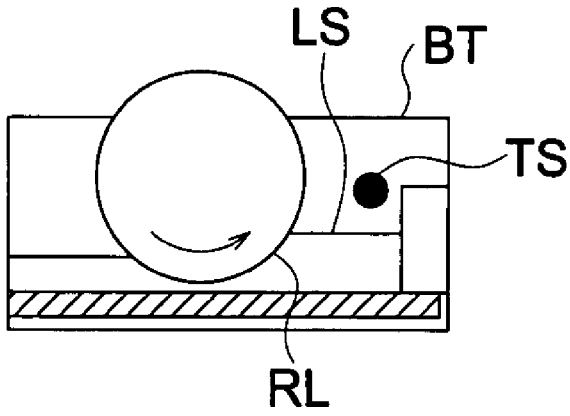
Figure 2:
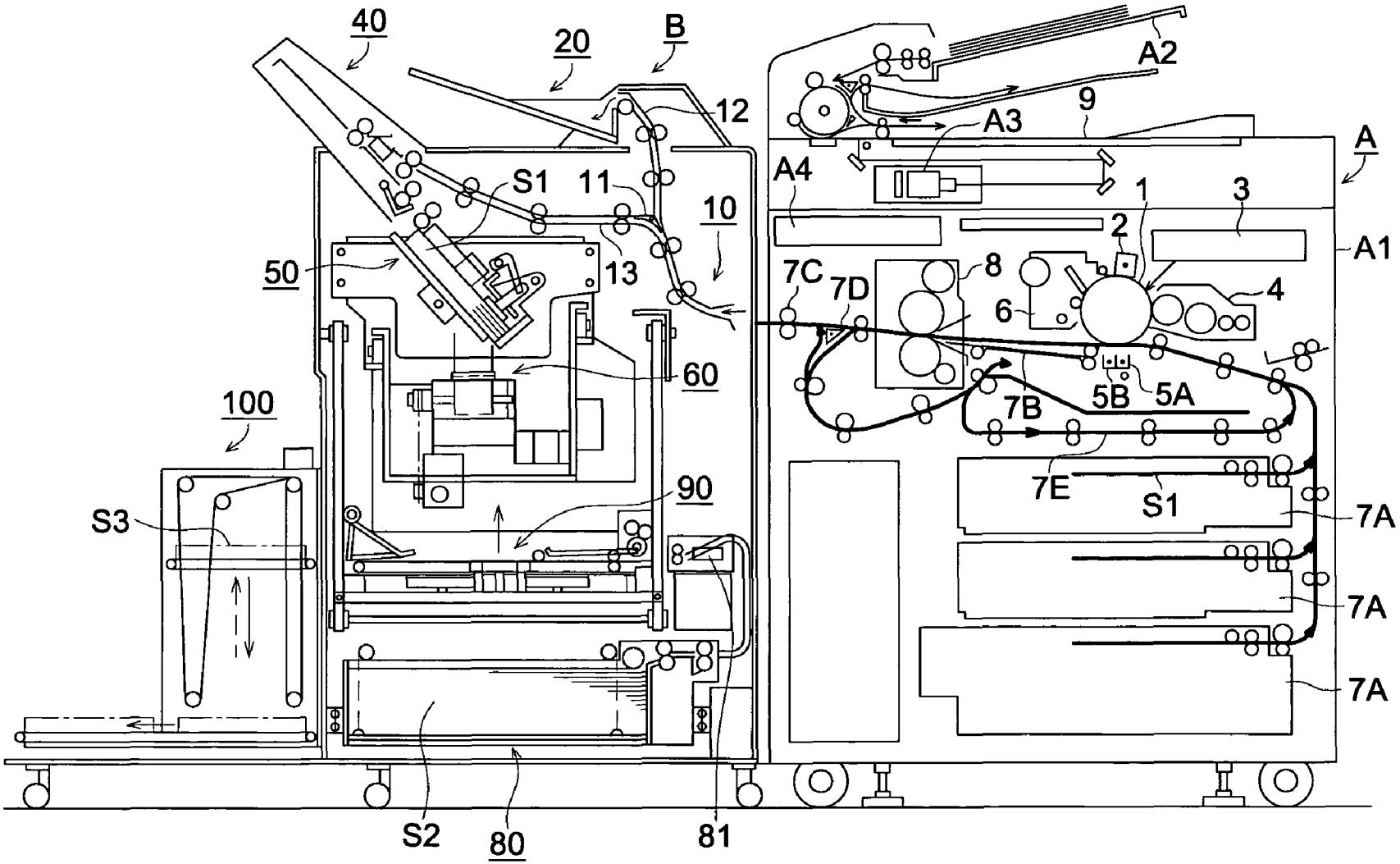
FIG. 2 is a diagram showing an entire image forming system provided with a bookbinding apparatus according to a preferred embodiment of the present invention.

FIG. 2 is a diagram showing an entire image forming system provided with a bookbinding apparatus according to a preferred embodiment of the present invention.

The image forming system has an image forming apparatus A and a bookbinding apparatus B.

The image forming apparatus A is one that forms images on sheets using the electro-photography method, and has an image forming section A1, a document feeding device A2, and an image reading section A3.

In the image forming section A1 arranged are a charging unit 2, an exposure unit 3, a developing unit 4, a transfer unit 5A, a separation unit 5B, and a cleaning unit 6 on the periphery of a drum shaped photoreceptor 1, and using these electrophotographic process devices, a toner image is formed on the photoreceptor 1 and the image is formed on the sheet S1 after charging, exposure, developing, and transfer are carried out.

The sheets S1 are stored in three sheet feeding trays 7A, and one sheet at a time of the sheet S1 is fed from these sheet feeding trays 7A, and the toner image on the photoreceptor 1 is transferred on to the sheet S1 by the transfer unit 5A.

The toner image transferred onto the sheet S1 is fixed by passing through the fixing unit 8. The fixed sheet S1 either is discharged by the ejection roller 7C or is conveyed to the re-feeding path 7E.

According to face-down sheet discharge in single-sided printing, face-up sheet discharge in single-sided printing, or front surface image formation in double-sided image formation, the switching gate 7D switches and guides the sheet S1. In other words, during face-up sheet discharge, the switching gate 7D causes the sheet S1 to proceed forward, and in face-down sheet discharge or in double-sided image formation, the switching gate 7D guides the sheet S1 downwards.

In face-down sheet discharge, the sheet S1, after being guided downwards, is switched back and is conveyed in the upward direction, and is then discharged by the ejection roller 7C.

In double-sided image formation, the sheet S1 is guided downwards, after being turned upside down by switching back, it passes through the sheet feeding path 7E, fed to the transfer section in which is placed the transfer unit 5A, and the image of the back surface is transferred onto it.

The document feeding device A2 conveys the document one sheet at a time to the reading position. The image reading section A3 reads out the image of the document conveyed by the document feeding device A2 or the image of the document placed on the document table 9, and generates the image signals.

The bookbinding apparatus B is an apparatus that stacks a plurality of sheets that constitute a book and that are fed from the image forming apparatus A, and configures a stack of sheets to be formed into a book, joins a cover sheet to that stack of sheets, and prepares a book. In the following explanations, the sheets constituting a book are called sheets S1, and the cover sheet is called a cover S2, and the sheets constituting a book to which a cover sheet has been joined is called a booklet S3.

The bookbinding apparatus B has a conveying section 10 that conveys the sheets S1 discharged from the image forming apparatus A either to an ejection tray 20 or to a sheet reversing section 40, an ejection tray 20, a sheet reversing section 40, a stacking section 50 that stacks the sheets S1 sent one sheet at a time or several sheets at a time, a coating device 60, a cover sheet storing section 80 that stores the cover sheets S2, a cover sheet supporting section 90 that supports the cover sheet S2, and a booklet ejection section 100.

The sheet S1 discharged from the image forming apparatus A either is discharged to the ejection tray 20 via the ejection path 12 or is conveyed to the sheet reversing section 40 by the switching gate 11 provided in the conveying section 10. If the mode of operation is not the bookbinding mode, the sheets S1 are discharged to the ejection tray 20.

In the bookbinding mode, the sheets S1 are conveyed to the sheet reversing section 40 via the conveying path 13, and, after being switched back in the sheet reversing section 40, they are conveyed to the stacking section 50. In the stacking section 50, the sheets S1 are stacked until the number of sheets becomes equal to a set number, the stacking section 50 is rotated when the number of sheets stacked becomes equal to the set number, and the stack of sheets S1 is held in an almost vertical condition.

Adhesive is coated by the coating device 60 on the bottom surface of the stack of sheets S1 held in the vertical condition by the stacking section 50.

A cover S2 is contacted with and adhered to the stack of sheets S1 on which adhesive has been coated.

The booklet S3 prepared by adhering the cover sheet S2 to the stack of sheets S1 is discharged to the booklet ejection section 100.

Figure 3:
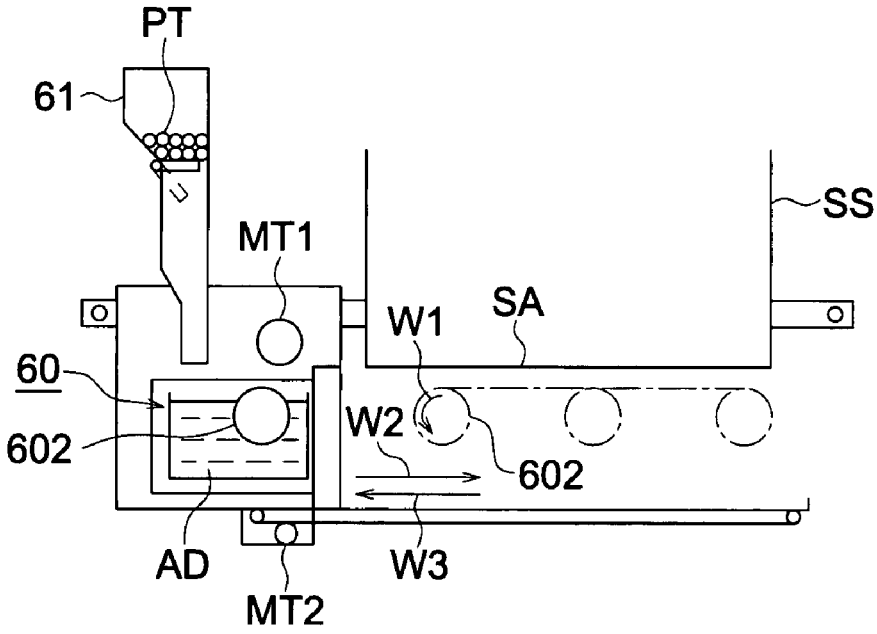
FIG. 3 is a diagram showing the coating process.

FIG. 3 is a diagram showing the coating process.

The coating device 60 is placed below the sheet stack SS of the sheets S1, and during its forward movement driven by the motor MT1 indicated by the arrow W2, the coating roller 602 coats the adhesive AD on the spine SA of the sheet stack SS, and during the reverse movement indicated by the arrow W3, the coating roller 602 coats the adhesive AD on the spine SA.

The home position of the coating device 60 is the left end position in FIG. 3, which is located at the deep side of the bookbinding apparatus shown in FIG. 2, and at this home position, pellets PT of the adhesive are replenished from the replenishment device 61. The coating roller 602 is rotated in the direction indicated by the arrow W1 due to the drive of the motor MT2 during the forward and reverse movements thereby scooping up the adhesive from the adhesive reservoir 601, and coats it on the spine SA of the sheet stack SS.

Figure 4:
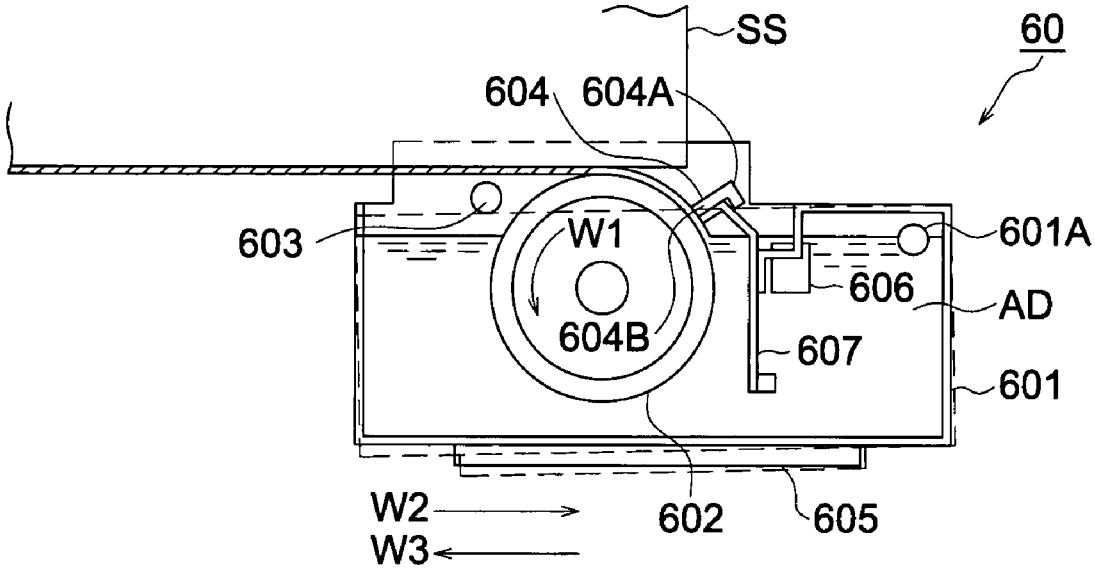
FIG. 4 is a diagram showing the configuration of the coating device 60.

FIG. 4 is a diagram showing the configuration of the coating device 60.

The coating device 60 has an adhesive reservoir 601 that stores the adhesive AD, a coating roller 602, two regulating members 603 and 604, a heater 605, and an adhesive quantity sensor 606.

Although the pellets inside the adhesive reservoir 601 are heated and melted by the heater 605 thereby forming the coating liquid of the adhesive AD, the quantity of the adhesive AD is detected by the adhesive quantity sensor 606 made up of a temperature sensor, and the liquid level is maintained constant. The part 603 is a regulating member having the shape of a rod with an almost circular cross-section, and the regulating member 604 is supported by a supporting member 607 having the shape of a plate, and limits the thickness of the layer of adhesive above the coating roller 602 using its bottom edge 604B, and restricts the thickness of the adhesive layer on the spine SA of the sheet stack SS using its top edge 604A.

The adhesive reservoir 601 is set by rotating from the standby state indicated by dotted lines to the coating state indicated by continuous lines around the shaft 601A.

The adhesive quantity sensor 606 has a temperature detecting device such as a thermistor, the detected temperature is high when the adhesive quantity sensor 606 is immersed in the liquid of the adhesive AD, and the detected temperature drops when the liquid level goes down and the adhesive quantity sensor 606 gets separated from the liquid level. The fact that the adhesive quantity has fallen below a prescribed value is detected by detecting this drop in the temperature.

The replenishment of the adhesive is carried out when the adhesive quantity drop detection signal is output.

The replenishment device 61 is explained here referring to FIG. 5 to FIG. 8.

Figure 5:
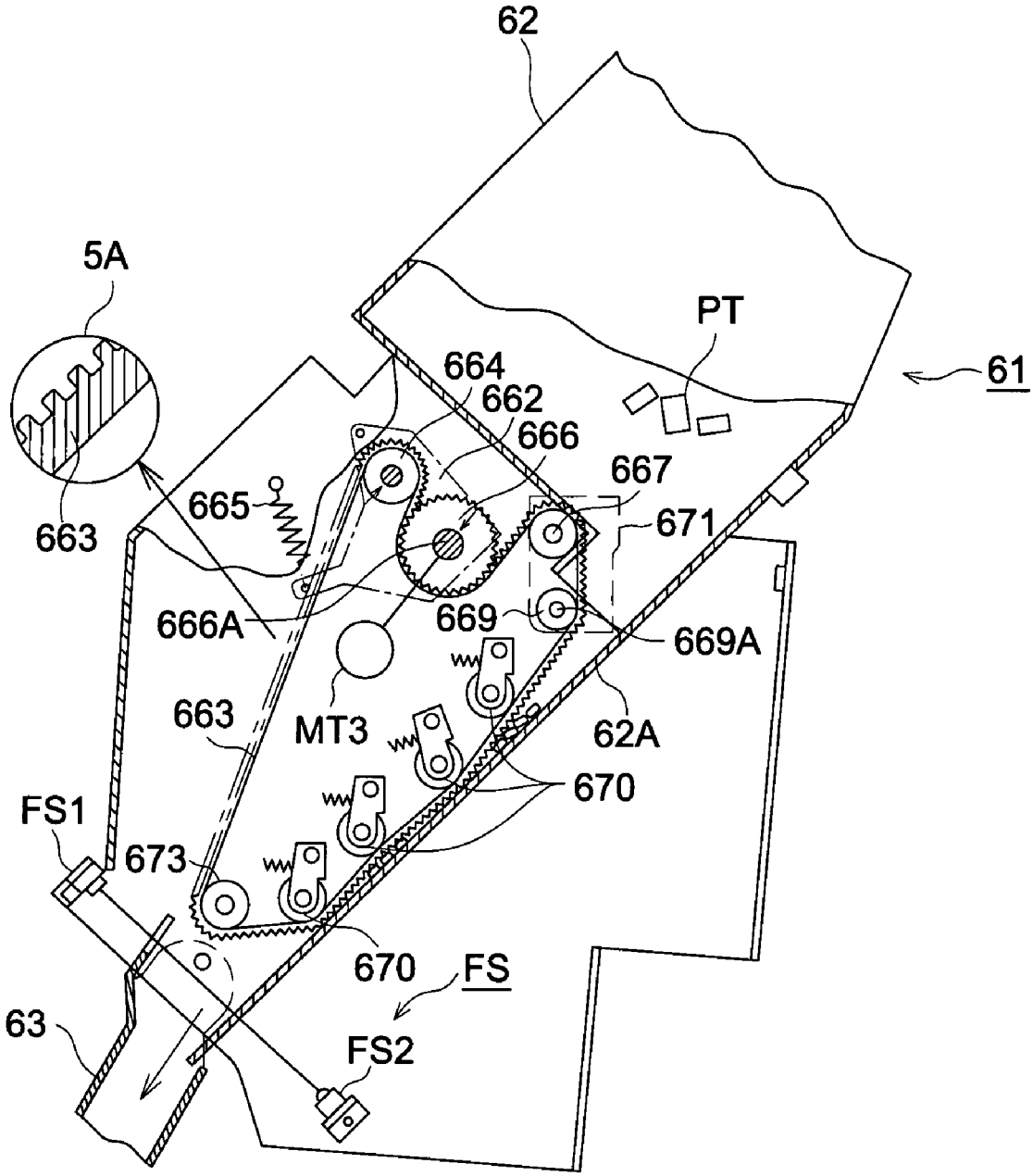
FIG. 5 is a cross-sectional view diagram of the replenishing device 61.
Figure 6:
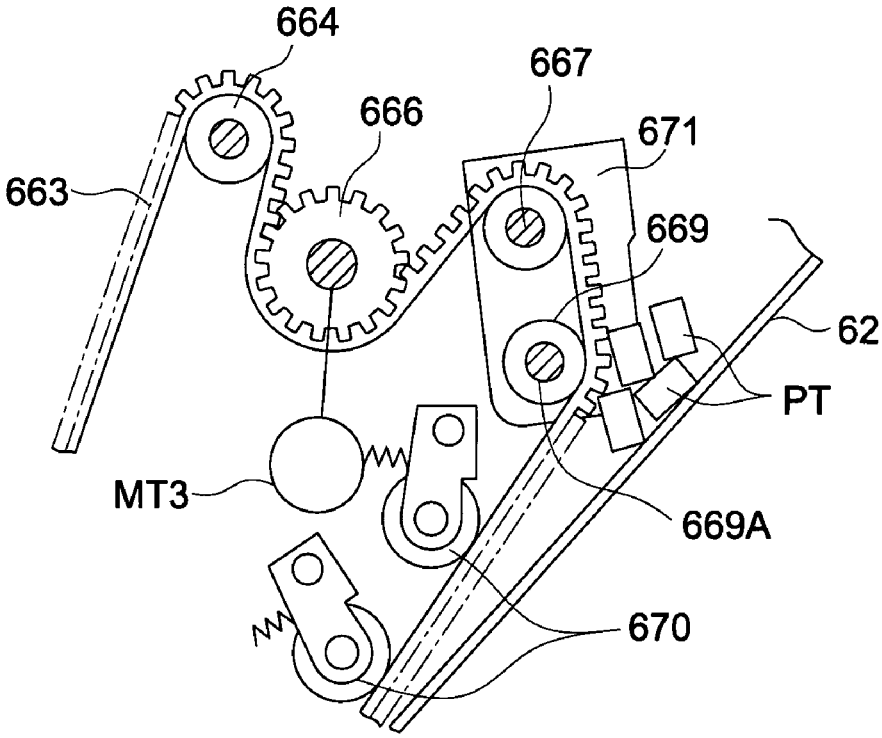
FIG. 6 is a diagram showing the important parts of the replenishing device 61 before the operations are started.
Figure 7:
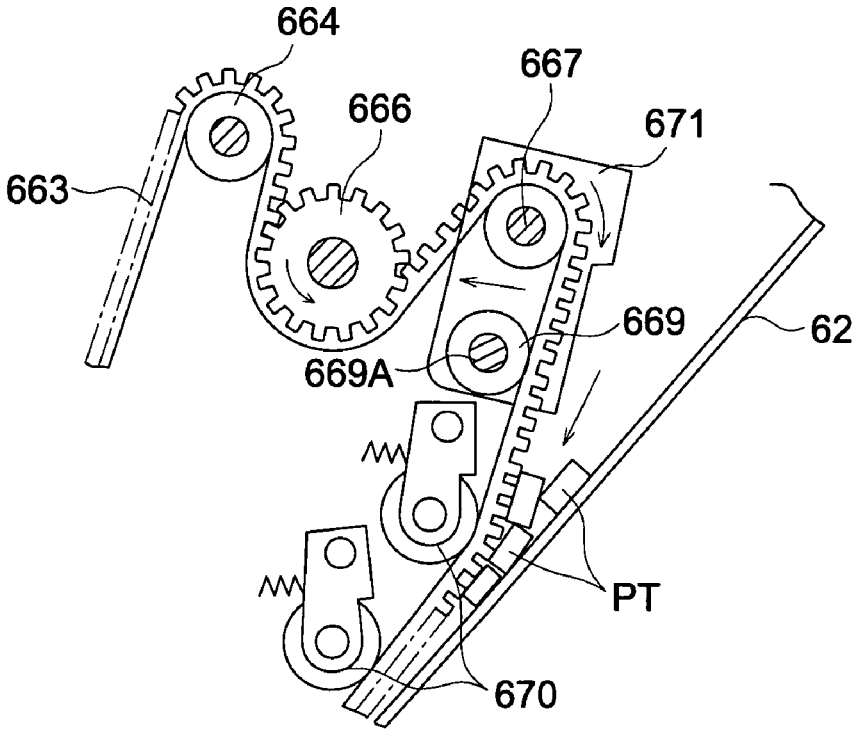
FIG. 7 is a diagram showing the important parts of the replenishing device 61 during replenishment.

FIG. 5 is a cross-sectional view diagram of the replenishing device 61, FIG. 6 shows the important parts of the replenishing device 61 before the operations are started, and FIG. 7 shows the important parts of the replenishing device 61 during replenishment. FIG. 8 shows the drive system in the replenishing device 61.

The replenishment device 61 is made up of a hopper 62 as the pellet storing section that stores the pellets PT of the adhesive and a replenishing pipe 63 through which the pellets PT drop down, and the frame 62A constituting the hopper 62 supports the different parts described below.

The replenishing device 61 is incorporated into the bookbinding apparatus B in the condition shown in FIG. 5, that is, in the condition in which the hopper 62 and the replenishing pipe 63 are inclined downward towards the left, and the pellets PT drop along the bottom surface of the frame 62A and the bottom surface of the replenishing pipe 63, and are supplied to the coating device 60.

The belt 663 that conveys the pellets PT is entrained about the rollers 664, 666, 667, 669 and 673 in the lower part of the hopper 62. The roller 666 is the drive roller and rotates in the anti-clockwise direction by being driven by the motor MT3 which is a constituent part of the replenishing member.

The belt 663 which is a constituent part of the replenishing member has undulations formed on its outer peripheral surface as is shown in the enlarge view diagram of FIG. 5A, and because of this undulating surface, not only the pellets are conveyed definitely, but also the area of contact with the pellets PT is made small thereby preventing adhesion between the pellets PT and the belt 663. Because four pressure rollers 670 press the belt 663 against the frame 62A using the force of springs, the spacing between the frame 62A and the belt 663 is restricted so that it does not become larger than a prescribed limiting value, and because of this, the amount of conveying of the pellets PT by the belt 663 is controlled to be almost constant.

The rollers 664 and 666 are supported by the supporting plate 662 that can swing centering on the rotating shaft 666A of the roller 666, and the supporting plate 662 is pulled in the clockwise direction by a pulling type spring 665. Because of this, a constant tension force is applied to the belt 663 by the roller 664 pulled by the spring 665.

The replenishing device 61 in the stopped state before starting operations is as shown in FIG. 6, and in this state, the roller 669 has narrowed the pellet discharge outlet, and the pellets PT stay in the hopper 62 being blocked by the belt 663 supported by the roller 669 as shown in FIG. 6.

When the replenishing device 61 starts operating, the roller 669 moves to the left as shown in FIG. 7, the belt 663 recedes, thereby making wide the pellet discharge outlet of the hopper 62. Because of this, the pellets PT drop up to the discharge outlet, and the pellets PT that have dropped fall along the bottom surface of the frame 62A due to the conveying action of the belt 663.

During the period when the replenishing device is carrying out replenishing operation, the roller 669 reciprocates between the position shown in FIG. 6 and the position shown in FIG. 7, and because of this reciprocating operation, the pellets PT drop in small quantities at a controlled rate and are supplied to the coating device 60.

The drive mechanism that makes the roller 669 carry out reciprocating movement is explained using FIG. 8.

A support plate 675 that rotates integrally with the roller 666 has been fixed to the shaft 666A of the roller 666, and a link 676 has been supported in a rotatable manner to the pin 677 provided at one end of the supporting plate 675.

The shaft 669A of the roller 669 engages with and enters into the long hole 676A provided in the link 676.

The shaft 669A of the roller 669 is pulled to the right in FIG. 8(*a*) by a pulling type spring 668. Therefore, the roller 669 is maintained at the prescribed position by the tension force of the belt 663 and the force of the spring 668.

Although the supporting plate 675 rotates due to the rotation of the roller 666, because of the rotation of the supporting plate 675, the right end position of the link 676 moves in the left and right directions in FIG. 7, and because of this movement, the position of the roller 669 moves in the left and right directions, and hence the pellet discharge outlet of the hopper 62 contracts and expands as is shown in the state in FIG. 6 and the state in FIG. 7.

This contraction and expansion are repeated during the replenishment operation, and the pellets PT are supplied to the coating device 60 in small quantities at a controlled rate.

Returning to FIG. 5, FS is a replenishment sensor that detects the pellets PT falling from the hopper 62, and is made of a light emitting device FS1 and a light receiving device FS2. The number of pellets PT supplied to the coating device 60 is detected by the replenishment sensor FS. The count of the number of pellets PT by the replenishment sensor FS is proportional to the number of pellets PT replenished.

Figure 9:
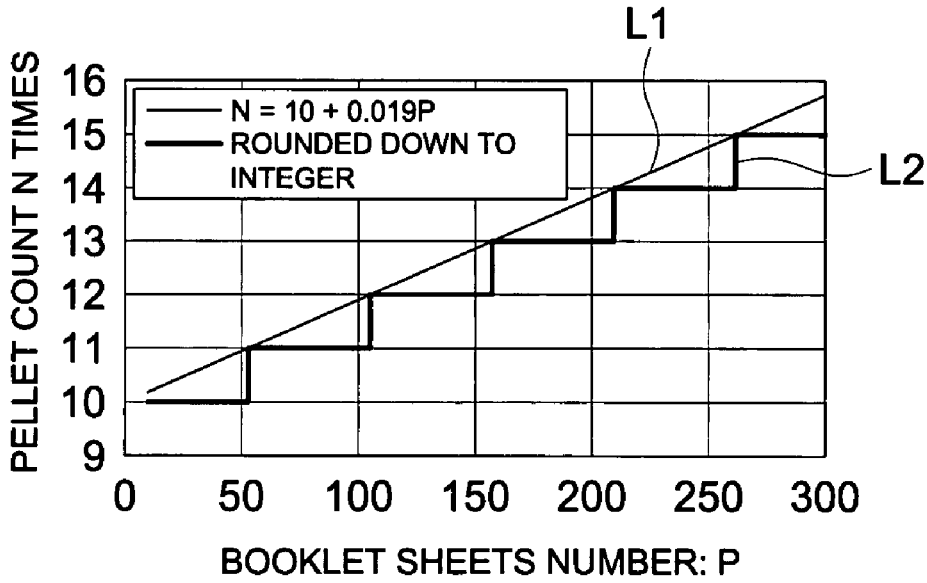
FIG. 9 is a diagram showing the rate of replenishment for carrying out appropriate adhesion for the number of sheets S1 constituting the sheet stack SS.

As has been explained above, while a drop in the liquid level of the adhesive AD is detected, and replenishment of the pellets PT of the adhesive is carried out based on the detection signal, the rate of replenishment of the pellets PT is explained here using FIG. 9. FIG. 9 is a diagram showing the rate of replenishment for carrying out appropriate adhesion for the number of sheets S1 constituting the sheet stack SS.

In FIG. 9, the horizontal axis denotes the number P of the sheets S1 constituting the sheet stack SS, and the vertical axis denotes the count N of the replenishment sensor FS of the pellets PT that have been replenished, and the graph shows the results obtained by carrying out a coating experiment using a coating apparatus of FIG. 4.

Further, although in FIG. 9 the horizontal axis is taken to indicate the number of sheets, theoretically, it is the quantity of adhesive consumed by coating, and the quantity of adhesive consumed corresponds, mainly, to the thickness of the sheet stack SS determined by the number of sheets and the thickness of each sheet, and to the sheet size. In addition, the quantity of adhesive consumed also changes depending on the type of sheet used, such as coated paper, non-coated paper, etc.

The straight line L1 is expressed by the following equation.

$$\text{Appropriate rate } N=10+0.019P \qquad \text{Equation 1}$$

However, the count of the replenishment sensor FS is not necessarily equal to the number of pellets replenished, and in the example of the experiment, one count of the replenishment sensor FS corresponded to 2.5 pellets.

Further, in the actual control, as is shown in the broken line L2, the number of pellets with the part below the decimal point being discarded is used as the appropriate replenishment quantity for the control. The controller (to be described later) receives the signal of detecting that the liquid level has fallen down from the adhesive quantity sensor 606 (shown in FIG. 4), starts feeding the pellets, and stops the replenishment when the count value corresponding to the quantity of replenishment corresponding to the number of sheets given by Equation 1 reaches the appropriate value shown in FIG. 9.

Because of this type of control, the liquid level LS of the adhesive is maintained at all times at almost a constant level, and uniform coating is done.

Figure 10:
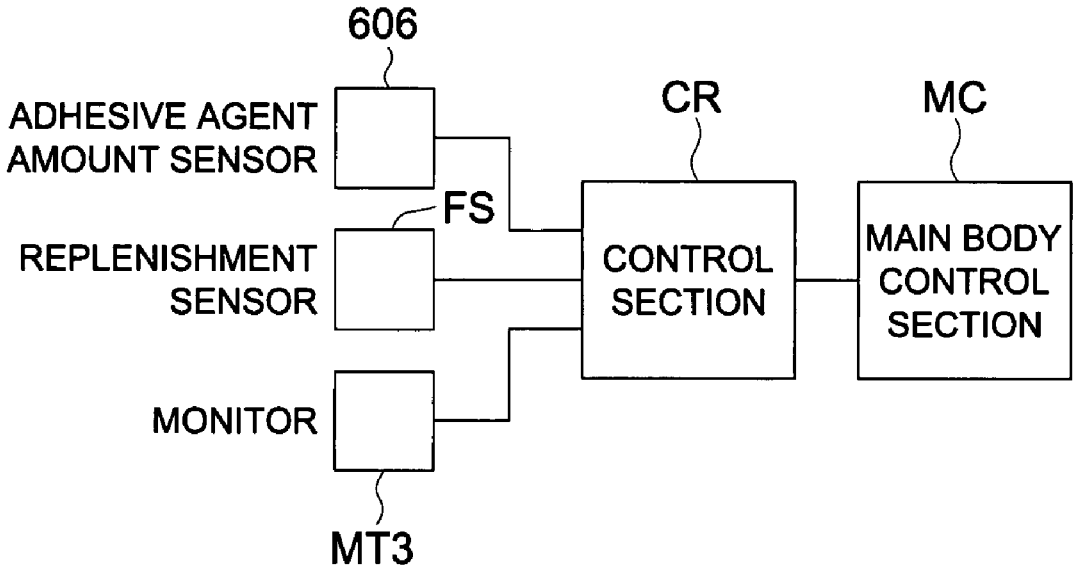
FIG. 10 is a block diagram of the control system carrying out control of the adhesive replenishment.
Figure 11:
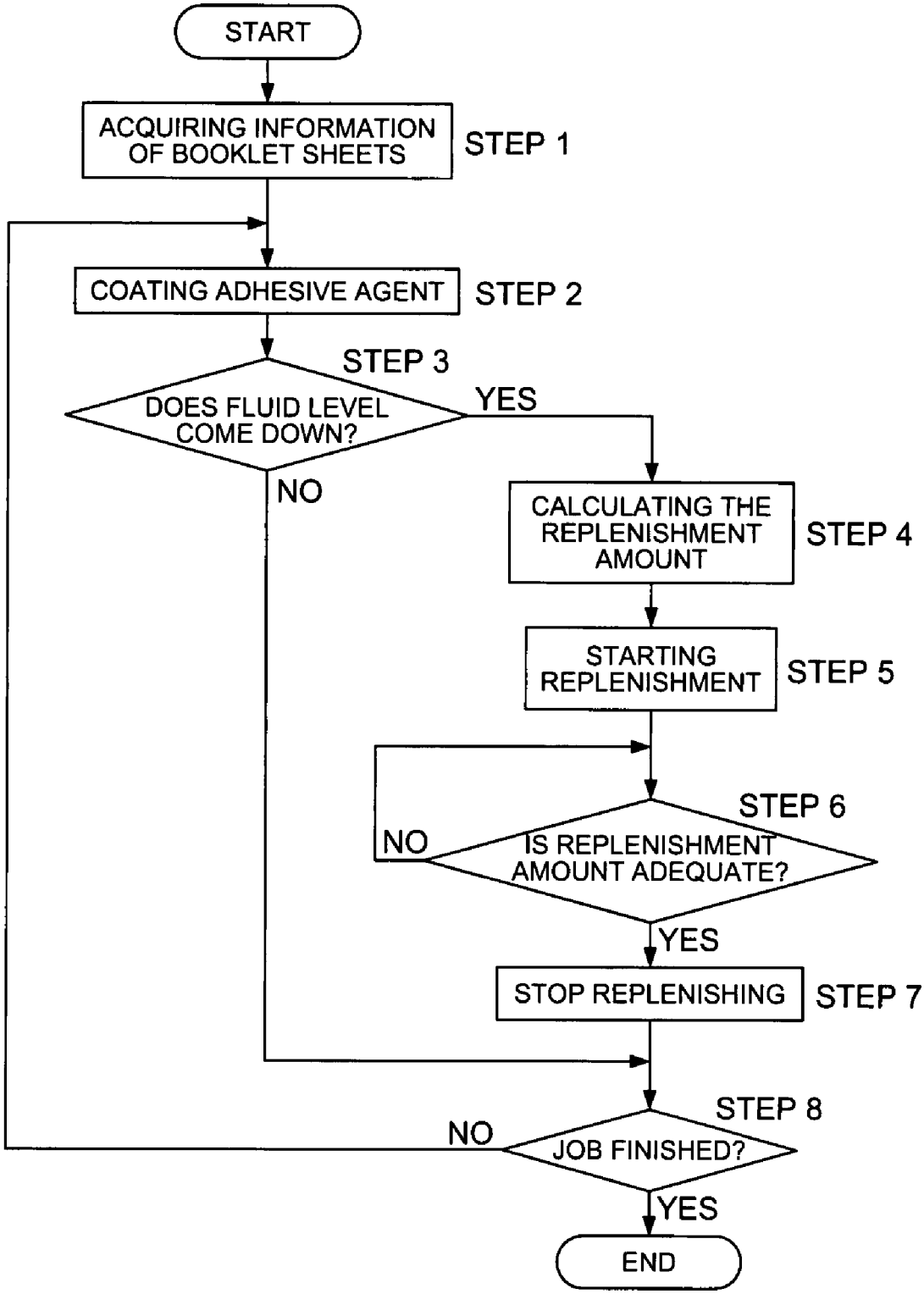
FIG. 11 is a flow chart of coating control.

FIG. 10 is a block diagram of the control system that carries out replenishment control, and FIG. 11 is a flow chart of the replenishment control carried out by the controller CR.

The replenishment control of adhesive is explained in the following referring to FIG. 10 and FIG. 11.

The controller CR acquires the information of the sheet stack SS from the main unit controller MC which is the control section of the image forming apparatus A, and, based on the liquid level low detection signal of the adhesive quantity sensor 606 that detects the liquid level in the adhesive reservoir, carries out the pellet replenishment control of starting the drive motor MT3 which is a constituent part of the replenishment section that replenishes pellets to the adhesive reservoir thereby supplying the pellets PT, and stopping the motor MT3 at the time when the replenishment quantity obtained from the replenishment quantity detection signal acquired from the replenishment sensor FS reached the appropriate value.

In STEP 1, the information of the sheet stack SS to be coated with the adhesive is input. The information of the sheet stack can be the number of sheets constituting the booklet, the thickness of each sheet, the paper type indicating the differences such as coated paper, non-coated paper, etc., the sheet size, etc.

In STEP 2, the coating device 60 makes a to-and-fro movement and the adhesive is coated on the spine of the sheet stack SS.

In STEP 3, lowering in the liquid level of the adhesive is detected after carrying out the coating process in STEP 2, and the operation is ended if no lowering is detected (N in STEP 3), and if a lowering is detected (Y in STEP 3), the appropriate coating quantity is calculated (STEP 4).

The calculation in STEP 4 is made, for example, following the broken line L2 in FIG. 9, and referring to the lookup table stored in the storage section of the controller CR.

In STEP 5, the replenishment of pellets is started.

In STEP 6, the output of the replenishment sensor FS is monitored, and the replenishment is stopped (STEP 7) at the instant of time when the count value of the replenishment sensor FS reaches the appropriate value (Y in STEP 6).

The operations are ended when the set number of copies of the booklet has been formed and the bookbinding job is completed (Y in STEP 8), or else, if the job is not ended, the operations return to STEP 2 (N in STEP 8).

While in FIG. 10 and FIG. 11 the controller CR inputs the information of the sheet stack SS, and, based on that information, the pellet replenishment quantity is being determined, the information of the sheet stack SS, as has been described above, can be the number of sheets, the sheet thickness, the type of sheet, the sheet size, etc., apart from automatic replenishment of the controller CR calculating the rate of replenishment from these items of information, it is also possible for the operator to set directly the rate of replenishment.

For example, it is possible to provide the rate of replenishment in several steps and the operator selects and sets the appropriate rate of replenishment from among these steps based on the thickness of the sheet stack SS, etc., and the setting by the operator is input to the controller CR as information of the sheet stack SS.

In automatic replenishment control, while the controller CR acquires the information of the number of sheets, the sheet thickness, the sheet size, etc., from the image forming apparatus A and calculates the appropriate rate of replenishment, it is also possible to have a configuration in which a sheet thickness sensor to detect the thickness of the sheet stack is provided in the stacking section 50 of the sheet stack SS in FIG. 2, and the controller CR calculates the appropriate rate of replenishment based on the detection signal from the sheet thickness sensor.

In the embodiment, since predictive control is being made of calculating the appropriate quantity of replenishment of adhesive based on the information of the stack of sheets constituting the booklet, and carrying out the replenishment, even in the case of a small size coating apparatus, it is possible to realize a bookbinding apparatus that prepares high quality booklets by carrying out uniform coating of the adhesive at all times, and maintaining high adhesion strength.

What is claimed is:

1. A bookbinding apparatus for forming a booklet by coating an adhesive on a spine of a stack of sheets, comprising:

a coating apparatus, having:

an adhesive reservoir for storing a liquid of the adhesive; and a coating roller for coating on the spine of the stack of sheets the adhesive scooped up from the adhesive reservoir;

a pellet storage section for storing pellets of the adhesive;

a replenishing section for replenishing the pellets of the adhesive from the pellet storage section into the adhesive reservoir;

an adhesive quantity sensor for detecting a liquid level in the adhesive reservoir; and a controller for controlling the replenishing section based on a detection signal of the adhesive quantity sensor, wherein the controller calculates a rate of replenishing the pellets based on information of the stack of sheets, the information comprising a number of sheets included in the stack of sheets, and wherein the controller controls the rate of replenishing the pellets by controlling the replenishing section based on the calculated rate of replenishing the pellets.

2. The bookbinding apparatus of claim 1, wherein the information of the stack of sheets further comprises at least one piece of information of a thickness of a sheet in the stack of sheets, a type of the sheet, and a size of the sheet.

3. The bookbinding apparatus of claim 1, further comprising:

a replenishment sensor for detecting an amount of the pellets to be replenished by the replenishing section, wherein the controller controls the replenishing section based on a signal from the replenishment sensor.

4. A bookbinding system, comprising:

an image forming apparatus for forming images on sheets; and a bookbinding apparatus for forming a booklet by coating an adhesive on a spine of a stack of sheets received from the image forming apparatus, the book binding apparatus comprising:

a coating apparatus, having:

an adhesive reservoir for storing a liquid of the adhesive; and a coating roller for coating on the spine of the stack of sheets the adhesive scooped up from the adhesive reservoir;

a pellet storage section for storing pellets of the adhesive;

a replenishing section for replenishing the pellets of the adhesive from the pellet storage section into the adhesive reservoir;

an adhesive quantity sensor for detecting a liquid level in the adhesive reservoir; and a controller for controlling the replenishing section based on a detection signal of the adhesive quantity sensor, wherein the controller calculates a rate of replenishing the pellets based on information of the stack of sheets, the information comprising a number of sheets included in the stack of sheets, and wherein the controller controls the rate of replenishing the pellets by controlling the replenishing section based on the calculated rate of replenishing the pellets.

5. An adhesive coating method for coating an adhesive on a spine of a stack of sheets by moving a coating apparatus relative to the stack of sheets along the spine of the stack of sheets, the coating apparatus having an adhesive reservoir for storing a liquid of the adhesive and a coating roller for coating the adhesive scooped up from an adhesive reservoir, the adhesive coating method comprising:

detecting a liquid level of the adhesive in the adhesive reservoir by an adhesive quantity sensor;

calculating a rate of replenishing the pellets based on information of the stack of sheets, the information comprising a number of sheets included in the stack of sheets; and activating, based on the calculated rate of replenishing the pellets, a replenishing section to replenish the pellets of the adhesive from a pellet storage section into the adhesive reservoir, when lowering of the liquid level is detected by the adhesive quantity sensor.

6. An adhesive coating method of claim 5, wherein the rate of replenishing the pellets is changed based on instructions from a user.

7. An adhesive coating method of claim 6, wherein the rate of replenishing the pellets is changed based on information of the stack of sheets.

8. The adhesive coating method of claim 5, wherein the information of the stack of sheets further comprises at least one piece of information of a thickness of a sheet in the stack of sheets, a type of the sheet, and a size of the sheet.

* * * * *